United States Patent [19]

Avellanet et al.

[11] 4,376,589

[45] Mar. 15, 1983

[54] MULTI-PLY UNGLUED PAPER DRIVE APPARATUS

[75] Inventors: Frank J. Avellanet, Plantation; Robert L. Battey, Fort Lauderdale; Lloyd J. Burtrem, Bola Raton, all of Fla.

[73] Assignee: Burroughs Corporation, Orlando, Fla.

[21] Appl. No.: 284,687

[22] Filed: Jul. 20, 1981

[51] Int. Cl.[3] ..... B41J 15/20

[52] U.S. Cl. ..... 400/606; 400/642; 400/616.3; 226/53

[58] Field of Search ..... 226/53, 86, 76, 194; 400/616.3, 616, 642, 228, 611

[56] References Cited

U.S. PATENT DOCUMENTS

| | | | |
|---|---|---|---|
| 1,189,263 | 7/1916 | Krauth | 226/53 |
| 1,249,191 | 12/1917 | Quigley | 226/53 |
| 1,698,401 | 1/1929 | Hagemann | 226/53 |
| 1,979,700 | 11/1934 | May | 226/86 |
| 2,103,110 | 12/1937 | Dickhant et al. | 226/53 |
| 2,327,480 | 8/1943 | Whitehead | 226/86 |
| 3,132,857 | 5/1964 | Carlson | 226/194 |
| 3,372,848 | 3/1968 | MacDonald et al. | 226/194 |
| 3,549,068 | 12/1970 | Calano | 400/616.3 |
| 3,650,448 | 3/1972 | Jarmy | 226/86 |
| 3,656,602 | 4/1972 | Konkel et al. | 400/616 |
| 3,746,142 | 7/1973 | Hepp et al. | 400/616.3 |
| 3,807,616 | 4/1974 | Hope et al. | 226/194 |
| 4,024,942 | 5/1977 | Kawaji | 400/642 |
| 4,284,222 | 8/1981 | Hank | 226/194 |

FOREIGN PATENT DOCUMENTS

| | | | |
|---|---|---|---|
| 518098 | 11/1955 | Canada | 226/86 |
| 668606 | 8/1963 | Canada | 226/53 |
| 110572 | 4/1964 | Czechoslovakia | 400/611 |
| 40-19335 | 10/1965 | Japan | 226/53 |

*Primary Examiner*—William Pieprz

*Attorney, Agent, or Firm*—Carl Fissell, Jr.; Kevin R. Peterson; David Rasmussen

[57] ABSTRACT

Paper drive apparatus for multi-ply unglued paper wherein a centrally disposed pin wheel member is rotatable in contact with a backup member the latter having a central groove or slot into which the pins of the pin wheel member are rotatably receivable. Unglued, multi-ply paper is fed into the nip between the pin wheel member and the bifurcated backup roller across a demountable, flexible paper guide, the latter ensuring the proper angle of entry of the unglued paper with respect to the nip between the pin wheel and backup roller.

4 Claims, 7 Drawing Figures

MULTI-PLY UNGLUED PAPER DRIVE APPARATUS

BACKGROUND OF THE INVENTION

1. Field of the Invention

The present invention relates to high speed printing apparatus and more particularly to means for moving multiple, unglued plies of paper into a printing apparatus for printing thereon through carbonless transfer material or interlayered carbon paper.

2. Description of the Prior Art

In the printing industry generally and the banking industry particularly there is a need or a requirement for printing multiple copies at high speed of data which is amassed from other sources of information such, for example, in the banking industry, as checks and deposits. In the computer art for example it is known to employ special cut form folded, edge perforated, multi-ply paper for printouts. In this application the paper is driven through the printing mechanism by means of parallel, oppositely disposed "tractors" which straddle the edge perforations of the paper and by means of vertical projections which protrude through and penetrate a short distance into the holes in the paper, the paper is moved into and through the printing apparatus.

The foregoing requires specially designed and formulated paper and paper driving tractors to perform the multi-ply printing operation. The paper and tractor mechanism combination is costly, noisy and requires personnel maintenance to avoid clogging and jamming of the tractors.

As the size of the printing apparatus has decreased, little or no room has been left for the outboard tractor devices. In the modern, modular, demountable printing apparatus used in many banking applications the design of the printer is such as to accommodate only a single ply of paper or with difficulty two glued plies. However, in most banking situations there is a need for two or more plies of unglued paper since one copy of the check amounts to be processed is attached to the bundle of checks and routed to the clearing house while the second copy of the printed material is maintained as an archival record for proof purposes.

Presently, the solution to this problem has been to glue the two plies together to prevent misregistration between the top and bottom ply. Again, this is costly and cumbersome to handle and requires special paper rolls. Since registration of both copies is of prime importance in maintaining adequate and clear data record proof, to date the glued paper has been the only means available to the industry. However, it must be pointed out in this connection that as the glue sections are burst apart or breakdown in use the obvious misregistration occurs so that in the final analysis the glued copies are really not much more than a make-shift solution to the basic problem.

SUMMARY OF THE INVENTION

The present invention is a novel means for utilizing multi-ply, unglued paper in a printer providing accurate, continuous registration of copies through carbonless transfer means or carbon paper or other transfer device without the need for specially prepared paper or specially prepared devices to enable or guarantee registration.

In a preferred embodiment, the present invention comprises a rotatable, resilient paper feeding roller member carrying about its central periphery a plurality of separate, radiating, elongated pins, tapered at the ends and of sufficient length to penetrate two or more plies of registered but unattached or unglued paper. For example, listing roll paper can be used in multiple form with one or more of the plies including carbonless transfer material.

Arranged beneath the pin carrying paper feeding roller, in surface contact therewith, is a paper holding or guiding backup roller. The central portion of the paper holding or backup roller is undercut, notched or grooved so as to receive the projecting pins of the paper feeding roller as the paper feeding roller is rotated there against. The confronting sides of the undercut portion of the paper holding roller are slightly inwardly canted or angled so as to provide means for automatically removing paper debris or dust and lint which might be deposited as a result of the individual pins perforating the paper as the roller is rotated. Opposite ends of the paper holding or backup roller tend to keep the paper in a straight line as it is fed from the supply field to the printing mechanism.

A snap-in demountable rigid although slightly flexible sheet metal paper guide is arranged to be positioned between the paper feeding roller and the paper guiding roller on outwardly extending studs or projections. This enables an operator to dismount the guide in case of a paper jam as well as permitting ease of access for cleaning and/or replacement of these parts. The paper guide permits the paper to be fed at a substantial horizontal angle into the nip between the two confronting rollers and into the printer effectively eliminating any drag coefficient on the paper and thus avoiding tearing, breaking or other assorted paper feeding problems.

The other advantages of the present invention will be readily appreciated as the same becomes better understood by reference to the following detailed description when considered in conjunction with the accompanying drawings.

DETAILED DESCRIPTION OF A SPECIFIC EMBODIMENT OF THE INVENTION

Figure 1:
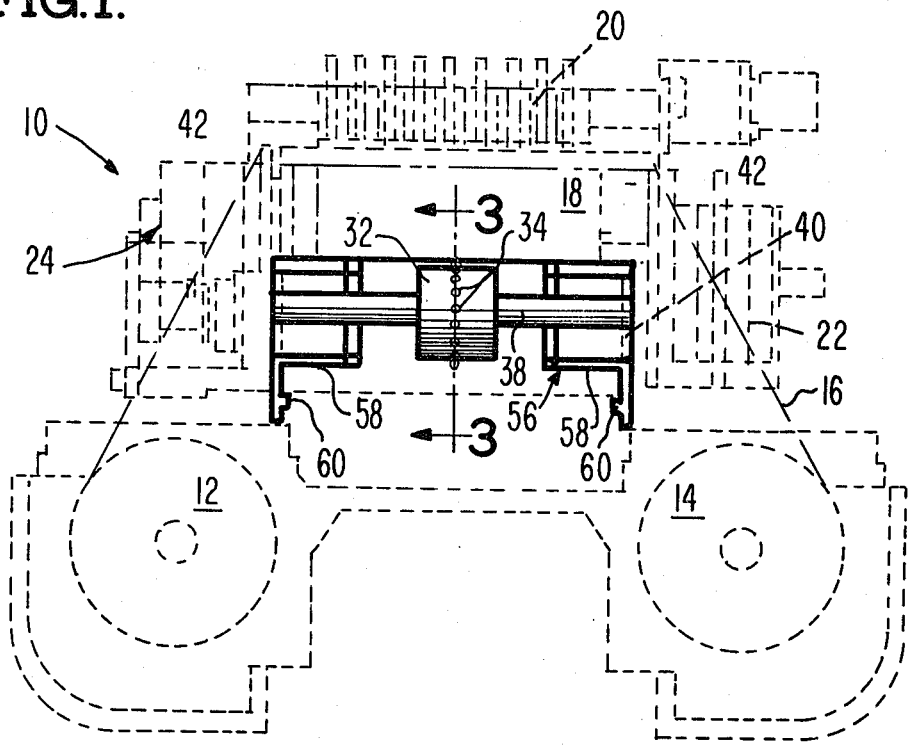
FIG. 1 is a top plan view of apparatus embodying the present invention.
Figure 2:
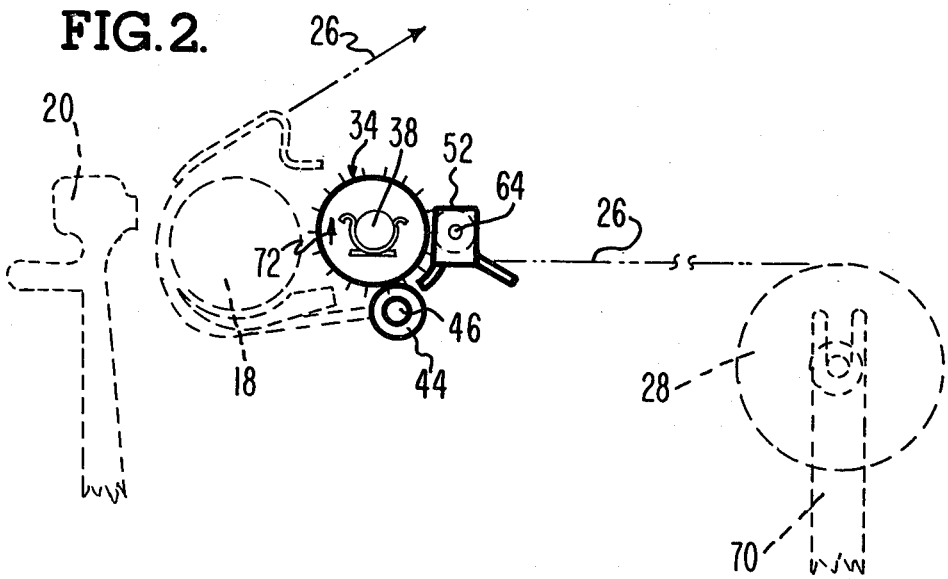
FIG. 2 is a highly schematic, side elevational view of the apparatus of FIG. 1.
Figure 7:
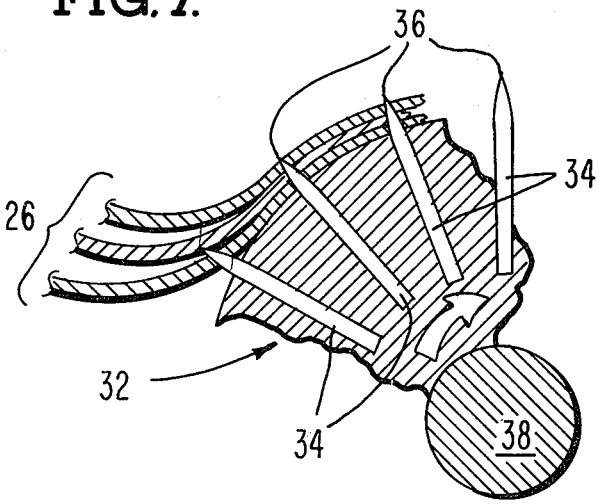
FIG. 7 is a greatly enlarged cross sectional detailed view of a portion of the pin wheel paper drive roller illustrating the pins penetrating the multi-layered unglued paper.

FIG. 1 is a top plan view of the apparatus embodying the present invention as incorporated in a small modular type high speed lister/printer. The additions and modifications are shown in full line. The printer per se is illustrated in dotted outline to avoid confusion. The printer 10 is seen to include a ribbon spool supply 12 and a takeup spool 14. A ribbon 16 is fed from the supply spool 12 out and around the print-roller drum 18 to the takeup spool 14 passing in front of the hammer bank 20. Electromagnetic drive means 22 operably rotates the print drum 18 on demand through reduction gear train 24. The hammer bank is selectively actuated by means of solenoids (not shown) to cause printing on lister-printer type multi-ply unglued paper 26 fed from supply reel 28, FIG. 2, as will be described in more detail later on. The present invention is directed to those applications wherein multi-ply paper is employed. For example, as seen in FIG. 7 the multi-ply paper 26 is illustrated together with interleaved carbon paper 30. However, it is noted that carbonless transfer paper of known type can be employed with the invention, thereby avoiding the need for carbon paper per se.

Multi-ply paper can be fed into printing apparatus but to do so requires that the paper plies be glued together so as to avoid the slippage of one ply with respect to another when the feeding is accomplished by use of confronting rubber tire rollers, and etc. Unless car is taken to see that the plies are not separated (slid over one another) as printing is performed, the data on the underlying plies tends to misregister relative to the data on the top ply leading to all sorts of accounting proof problems and summary balance discrepancies.

The present invention contemplates use of a centrally disposed pin wheel drive roller 32 of resilient material such for example as rubber or other similar material, slightly deformable, and capable of being readily rotated in so far as the weight of the roller is concerned. A series of vertically oriented outwardly extending rigid pin-like members 34 project from the periphery of the circular roller 32. The end 36 of each pin 34 is reduced to a conical point 36. Roller 32 is secured for rotation to a shaft 38, the opposite ends of which are provided with press fit mounting washers 40 receivable in the U-shaped openings in side frames 42. This permits the complete assembly 32 to be mounted and dismounted at will as the need arises for example, for cleaning, for paper jams, and etc.

Figure 3:
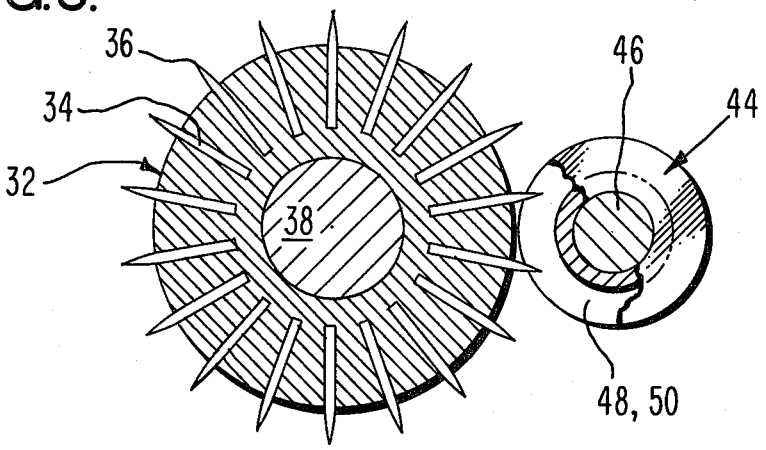
FIG. 3 is a view taken along the line 3—3 of FIG. 1 not drawn to scale.
Figure 4:
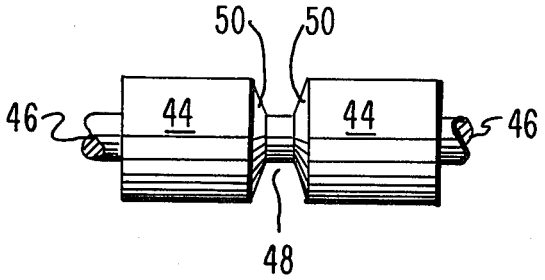
FIG. 4 is an enlarged detailed view of the backup roller illustrating the central undercut therein and the angled confronting shoulders.

Disposed beneath the pin wheel drive roller 32 is a demountable, bifurcated, backup roller 44 secured for rotation against drive roller 32 by means of a short stub shaft 46, the opposite ends of which are snap-mounted in U-shaped resilient holders (not shown) directly beneath roller 32. The central portion of roller 34 is provided with a circular slot or groove 48, the side walls 50 of which are inwardly canted at a slight angle enabling the device to be self cleaning. As seen most clearly in FIG. 3 the pins or projections 34 of wheel 32 are adapted to be rotatably received within the groove 48 as the pin wheel is rotated. The groove 48 thus provides a nominal clearance for the pins and prevents any bending or deformation of the lower roller. It is noted that the surface of roller 32 and 44 press against the paper so that drive roller 34 can feed the paper, as will become clear as the description proceeds.

Figure 5:
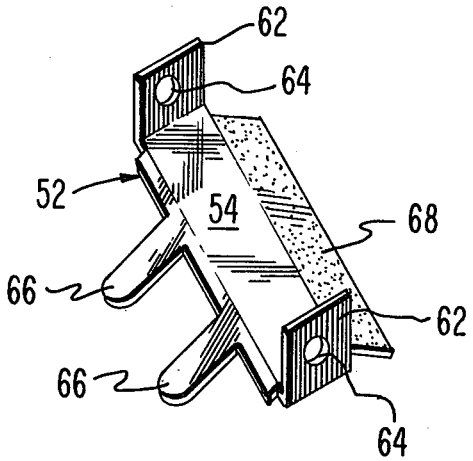
FIG. 5 is an isometric view of the demountable paper guide for the present invention.

In order to ensure the proper angle of entry of the paper tape 26 with the nip between rollers 34 and 44 a demountable, semi-rigid, slightly flexible paper guide member 52, FIG. 5, is mounted forward of the two confronting rollers so that its major surface portion 54 is substantially horizontal. As seen most clearly in the isometric drawing of FIG. 6, a sub-frame member 56 includes oppositely disposed, upturned portions 58 which prevent the paper tape from entangling itself with the embossed print drive roller or drum 18 but rather act to direct the paper into the nip between the two wheels or rollers 34 and 44. The forward opposite side walls of members 56 carry individual studs or projections 60. In this connection it is noted that member 52, the paper guide member earlier described, includes oppositely disposed upturned ends 62 provided with individual apertures or holes 64 and parallel rearwardly projecting finger-like tabs 66. The forward lip 68 of member 52 is angled slightly downward so as to prevent the incoming paper from hanging up thereon as it enters the nip between rollers 34 and 44.

Member 52 is inserted between rollers 34 and 44 with the tabs 66 resting upon opposite portions of shaft 46 and the shaft supports (not shown). The upstanding portions 62 are snapped over the studs 60 so as to seat the portions 62 thereon. The two finger-like members 66 prevent the guide from tilting or cocking downwardly during the operation of the device.

OPERATION OF THE INVENTION

Figure 6:
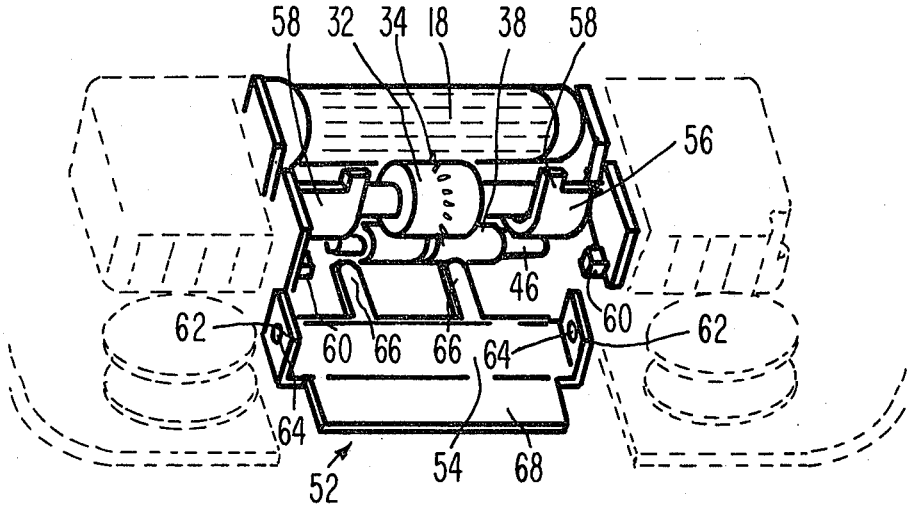
FIG. 6 is an isometric view of the pin wheel paper advance mechanism in conjunction with the grooved backup roller and the paper guide for this assemblage.

As seen particularly in the isometric view of FIG. 6 when the unglued multi-ply paper 26 is fed across the guide member 52 and into the nip between rollers 34 and 44 the pins of roller 34 project into and through the plies of paper as seen most clearly in FIG. 7 effectively driving the paper into the direction of the enlarged arrow in FIG. 7 into the area between the print carrying roller drum 18 and the hammer bank 20. At this point in time the hammer bank is selectively activated to cause printing to be produced on the plies of paper and assuming that either carbon or carbonless transfer material is used multiple copies of the printed data are printed on the paper web 26 after which the web is in turn either fan folded or rolled up on a takeup spool (not shown).

Of particular interest is the fact that with the use of the present invention multiple plies of "unglued" layered strip paper can be relatively easily drawn into the printer and printed upon and returned away from the printer without any misregistration between the top most ply and the succeeding plies of the layered sets of paper. The pin wheel is disposed centrally of the incoming web as noted particularly in view of FIG. 1. While FIG. 1 does not show the paper it is obvious that the paper web would be moving into and through and around the print drum and be guided by the side walls of the frame member 56. The tiny row of perforations which unlike chads in chadless tape remain with the paper are almost completely invisible because of the small size of the perforation so that they tend to be over looked by the operator and thus do not affect print quality nor produce any additional visual problems with the printing which is produced on the paper.

There has thus been described a new and novel and heretofore unobvious mechanism for advancing printer lister paper from rolls of paper into and through a printer at relatively high speed in a stop start fashion without need for having the multiple plies glued to one another and without having the requirement of specialized paper.

What is claimed is:

1. In printing apparatus having printing means including fixed data thereon and impact imparting means for printing on paper stock interposed between said impact imparting means and said printing means and wherein paper stock is fed from a supply to said printing means by a web drive means the improvement comprising;

means mounting multi-ply unperforated unglued paper stock adjacent to said printing means for feed to said printing means;

means for simultaneously engaging each of the plies of said paper stock so as to feed said stock with each ply in register with the other plies of said stock to said printing means, said means for simultaneously engaging each of said plies comprises a demountable, rotatable, resilient member provided with a circularly disposed ring of paper stock pentrating elements and having a drive engaging member axially aligned therewith for demountable engagement with operably associated web drive means of the printing apparatus means conjointly operable with said means for engaging each of the plies and having a longitudinal axial extent greater than said ply engaging means providing intimate longitudinal contact with said paper stock and acting to maintain said stock in a substantially flat condition adjacent to said printing means; and means for adjusting the entering angle of said paper stock relative to said printing means enabling said ply engaging means to entrap said plies prior to said printing means substantially horizontally eliminating any drag coefficient on the paper said means for simultaneously engaging and said means for adjusting being snap-in demountable with respect to said printing apparatus.

2. The invention in accordance with claim 1 wherein said conjointly operable means (backup roller) further comprises an elongated synthetic rubber member of approximately twice the length of said ply engaging means and wherein the central portion thereof is provided with a relatively deep under-cut offering clearance for the ply engaging projections and having shallow slanted sidewalls providing for debris clearance effective to prevent any accumulation of extraneous material from said plies of stock due to the penetration of the ply engaging means.

3. The invention in accordance with claim 1 wherein said means for adjusting the entering angle of said paper stock comprises a demountable, substantially flat, plate-like member adjustably disposed relative to said printing means and said paper stock engaging means so as to underlay the paper effective to present a relatively low angle of incidence thereto effectively avoiding any drag on said stock.

4. The invention in accordance with claim 1 wherein said snap-in means engaging the plies of paper includes oppositely disposed press fitted means engageable with fixed means on said printing apparatus permitting said paper engaging means to be removed, replaced and serviced as required.

* * * * *